US009132997B2

(12) United States Patent
Singhose et al.

(10) Patent No.: US 9,132,997 B2
(45) Date of Patent: Sep. 15, 2015

(54) CRANE CONTROL SYSTEMS AND METHODS

(75) Inventors: William Singhose, Atlanta, GA (US); Chen Chih Peng, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 270 days.

(21) Appl. No.: 13/642,075

(22) PCT Filed: Apr. 25, 2011

(86) PCT No.: PCT/US2011/033769

§ 371 (c)(1), (2), (4) Date: Oct. 18, 2012

(87) PCT Pub. No.: WO2011/133971

PCT Pub. Date: Oct. 27, 2011

(65) Prior Publication Data

US 2013/0032561 A1 Feb. 7, 2013

Related U.S. Application Data

(60) Provisional application No. 61/327,337, filed on Apr. 23, 2010, provisional application No. 61/358,164, filed on Jun. 24, 2010.

(51) Int. Cl.
*B66C 13/40* (2006.01)
*B66C 13/06* (2006.01)

(52) U.S. Cl.
CPC ..... *B66C 13/40* (2013.01); *B66C 13/063* (2013.01)

(58) Field of Classification Search
USPC ..... 212/272, 273, 275, 83, 97
See application file for complete search history.

(56) References Cited

U.S. PATENT DOCUMENTS

| | | | |
|---|---|---|---|
| 2002/0158036 | A1 | 10/2002 | Ong et al. |
| 2005/0242052 | A1 | 11/2005 | O'Connor et al. |
| 2006/0025894 | A1 | 2/2006 | O'Connor et al. |
| 2008/0027611 | A1 | 1/2008 | Recktenwald et al. |
| 2008/0281464 | A1 | 11/2008 | Sorensen et al. |
| 2009/0218305 | A1 | 9/2009 | Ikeguchi et al. |

OTHER PUBLICATIONS

International Search Report and Written Opinion for PCT Application No. PCT/US2011/033769 dated Aug. 1, 2011.

*Primary Examiner* — Emmanuel M Marcelo
(74) *Attorney, Agent, or Firm* — Troutman Sanders LLP; Ryan A. Schneider; Parker D. Hancock

(57) ABSTRACT

The various embodiments of the present disclosure relate generally to crane control systems. An exemplary embodiment of the present invention provides a crane control system comprising a real-time position-location module, an on-off controller module, and an input-shaper module. The real-time position-location module generates a position signal indicative of the distance between crane trolley and a desired location of safety. The on-off controller module maps the position signal to a velocity command signal, wherein the velocity command signal comprises instructions for the crane trolley to move in a vector relative to the desired location in at least a first velocity only if the distance between the crane trolley and the desired location is greater than a cut-off threshold 150. The at least a first velocity is a substantially constant. The input shaper module manipulates the velocity command signal mapped by the on-off controller module to dampen payload oscillations.

28 Claims, 15 Drawing Sheets

CRANE CONTROL SYSTEMS AND METHODS

CROSS-REFERENCE TO RELATED APPLICATIONS

This application is a 35 U.S.C. §371 United States National Stage Application of International Application No. PCT/US2011/33769, filed 25 Apr. 2011, which claims the benefit of U.S. Provisional Application Ser. No. 61/327,337, filed 23 Apr. 2010, and U.S. Provisional Application Ser. No. 61/358,164, filed 24 Jun. 2010, all of which are incorporated herein by reference in their entireties as if fully set forth below.

TECHNICAL FIELD OF THE INVENTION

The various embodiments of the present disclosure relate generally to control systems and methods. More particularly, the various embodiments of the present invention are directed to crane control systems and methods.

BACKGROUND OF THE INVENTION

Cranes play a key role in maintaining the economic vitality of modern-day industry. Their importance can be seen at shipyards, construction sites, warehouses, and in a wide variety of material-handling applications. The effectiveness of crane manipulation is an important contributor to industrial productivity, low production costs, and worker safety. Unfortunately, one inherent property of conventional crane assemblies that is detrimental to efficient operation is the natural tendency for the payload to oscillate like a pendulum, a double-pendulum, or with hoist-related oscillatory dynamics. Because crane operators can only drive the overhead crane trolley—not the payload—there is a response delay from the time the trolley moves to the time the payload moves. This delay results in oscillations in the payload as the trolley slows down (suddenly) or stops moving. The oscillating payload can be very dangerous to the payload, as it may collide with surroundings, or workers in the area. In conventional crane control systems, this delay causes cranes that contain rotational joints an especially challenging control problem because their nonlinear dynamics create additional complexities.

Significant efforts have been made to develop crane control systems that reduce the oscillatory response from both issued commands and external disturbances. Researchers have explored crane problems using neural networks and optimal control. There have also been developments in varying degrees of crane automation. Unfortunately, in addition to facing the challenges of controlling large amplitude, lightly-damped payload swing, operators of conventional crane control systems must also master non-intuitive machine interfaces, which require extensive training. Therefore, expert crane operators typically require years of experience and training. Some examples of conventional non-intuitive crane interfaces include push-button pendants, joysticks, and control levers.

FIG. 1 illustrates a conventional crane control system using a push button pendent interface. The operator must be adept in the cognitive process of transferring the desired manipulation path into a sequence of button presses that will produce the desired motion of the crane trolley 105. For example, if the operator wants to drive the payload 115 through a cluttered workspace using a push-button pendent 120, then the desired path must be mapped into a sequence of events where the "Forward", "Backward", "Left", and "Right" buttons are pushed for the correct time duration and in the correct sequence. Furthermore, as operators move through the workspace to drive the payload 115 and monitor its progress, they may rotate their bodies and change the directions they are facing. In such cases, the orientation of the buttons changes as the operators rotate their bodies. For example, the "Forward" button can cause relative motion to the left, right, or even backward. As an additional challenge, the operator can only directly drive the crane trolley 105, not the payload 115. Therefore, the operator must account for the time lag between the commanded motion of the crane trolley 105, which can be many meters overhead, and the delayed oscillatory response of the payload 115.

While significant strides have been made to improve the operational efficiency of cranes by controlling the dynamic response to issued commands, relatively little consideration has been given to the way in which operators issue those commands. Thus, there is a desire for crane control systems that allow an operator to intuitively issue control commands to a crane that result in minimal payload oscillations, such that the directional crane movement commands are unaffected by the operators changing rotational orientation.

BRIEF SUMMARY OF THE INVENTION

The present invention relates to crane control systems and methods. In a crane system comprising a crane trolley and a supporting device for carrying a payload, an exemplary embodiment of the present invention provides a crane control system useful for simplifying the crane system operation and for maintaining a safe distance between the payload and a specific location (most typically the location of a locator device, which is in the hand of the operator), the locator device for manipulating at least one of the position and speed of the supporting device. The crane control system is also useful in dampening payload oscillations when the crane trolley is either accelerated or decelerated. An exemplary crane control system comprises a real-time position-location module, an on-off controller module, and an input shaper module. The real-time position-location module generates a position signal indicative of a vector between an element of the crane system and the locator device used to manipulate at least one of the position and speed of the crane trolley. In an exemplary embodiment, the element of the crane system is the crane trolley, and the position signal is indicative of the horizontal planar distance between the crane trolley and the locator device. In another exemplary embodiment, the locator device is portable. The on-off controller module maps the position signal to a velocity command signal, wherein the velocity command signal comprises instructions for the crane trolley to move the supporting device in a vector relative to the locator device in at least a first velocity only if the magnitude of the vector between the element of the crane system and the locator device is greater than a cut-off threshold, wherein the at least a first velocity is a substantially constant velocity. The input shaper module manipulates the velocity command signal mapped by the on-off controller module to dampen payload oscillations when the crane trolley is accelerated or decelerated.

In another exemplary embodiment of the present invention, the cut-off threshold is determined as a function of acceleration and/or deceleration properties of the crane trolley. In yet a further exemplary embodiment of the present invention, the cut-off threshold is determined as a function of parameters of the payload. In yet another exemplary embodiment of the present invention, the cut-off threshold is determined in conjunction with properties of the input shaper module. In still yet another exemplary embodiment of the present invention, the cut-off threshold is determined as a function of a vector position of the locator device with respect to the crane trolley.

In another exemplary embodiment of the present invention, the at least a first velocity is equal to the first velocity if the magnitude of the vector between the element of the crane system and the locator device is greater than the cut-off threshold and less than or equal to an intermediate threshold, and the at least a first velocity is equal to a second velocity greater than the first velocity if the magnitude of the vector between the element of the crane system and the locator device is greater than the intermediate threshold.

In yet another exemplary embodiment of the present invention, the real-time position-location module uses characteristics of Ultra-Wide-Band ("UWB") Radio-Frequency ("RF") signals that are emitted by the locator device and received by a plurality of sensors.

Another exemplary embodiment of the present invention provides a radio-frequency-based crane control system comprising a real-time position-location subsystem, an on-off controller module, and an input shaper module. The real-time position location subsystem comprises a portable locator device, a plurality of sensors, and a real-time position-location module. The portable locator device emits UWB RF signals in response to an input. The plurality of sensors receives the UWB RF signals. The real-time position-location module uses the received UWB RF signals to generate a position signal indicative of a horizontal planar distance between the crane trolley and the portable locator device. The on-off controller module maps the position signal to a velocity command signal, wherein the velocity command signal comprises instructions for the crane trolley to move in a vector relative to the locator device in at least a first velocity only if the horizontal planar distance between the crane trolley and the locator device is greater than a cut-off threshold, wherein the at least a first velocity is a substantially constant velocity. The input shaper module manipulates the velocity command signal mapped by the on-off controller module to dampen payload oscillations when the crane trolley is accelerated or decelerated.

In an exemplary embodiment of the crane control system, the at least a first velocity is equal to the first velocity if the horizontal planar distance between the crane trolley and the locator device is greater than the cut-off threshold and less than or equal to an intermediate threshold, and the at least a first velocity is equal to a second velocity greater than the first velocity if the horizontal planar distance between the crane trolley and the locator device is greater than the intermediate threshold.

Another exemplary embodiment of the present invention provides a method of controlling a crane system comprising generating a position signal indicative of a vector between a locator device and an element of the crane system, mapping the position signal to a velocity command signal, and manipulating the velocity command signal to dampen payload oscillations when the crane trolley is accelerated or decelerated. In an exemplary embodiment of the method of controlling a crane system, the step of generating a position signal uses characteristics of UWB RF signals that are emitted by the locator device and received by a plurality of sensors.

These and other aspects of the present invention are described in the Detailed Description below and the accompanying figures. Other aspects and features of embodiments of the present invention will become apparent to those of ordinary skill in the art, upon reviewing the following description of specific, exemplary embodiments of the present invention in concert with the figures. While features of the present invention may be discussed relative to certain embodiments and figures, all embodiments of the present invention can include one or more of the features discussed herein. While one or more embodiments may be discussed as having certain advantageous features, one or more of such features may also be used with the various embodiments of the invention discussed herein. In similar fashion, while exemplary embodiments may be discussed below as system or method embodiments, it is to be understood that such exemplary embodiments can be implemented in various devices, systems, and methods of the present invention.

BRIEF DESCRIPTION OF DRAWINGS

The following Detailed Description of preferred embodiments is better understood when read in conjunction with the appended drawings. For the purposes of illustration, there is shown in the drawings exemplary embodiments, but the subject matter is not limited to the specific elements and instrumentalities disclosed.

DETAILED DESCRIPTION OF THE INVENTION

To facilitate an understanding of the principles and features of the present invention, various illustrative embodiments are explained below. In particular, the invention is described in the context of being crane control systems and methods. Embodiments of the present invention may be applied to systems or methods for controlling the movement of elements of a crane system via a locator device. Embodiments of the invention, however, are not limited to only use in systems and methods for controlling a crane system. As those of ordinary skill in the art would understand, embodiments of the invention can be used by other systems or methods for controlling other systems via a locator device using, for example, RF signals, SONAR, RADAR, GPS, and the like.

The components described hereinafter as making up various elements of the invention are intended to be illustrative and not restrictive. Many suitable components or steps that would perform the same or similar functions as the components or steps described herein are intended to be embraced within the scope of the invention. Such other components or steps not described herein can include, but are not limited to, for example, similar components or steps that are developed after development of the invention.

Figure 1:
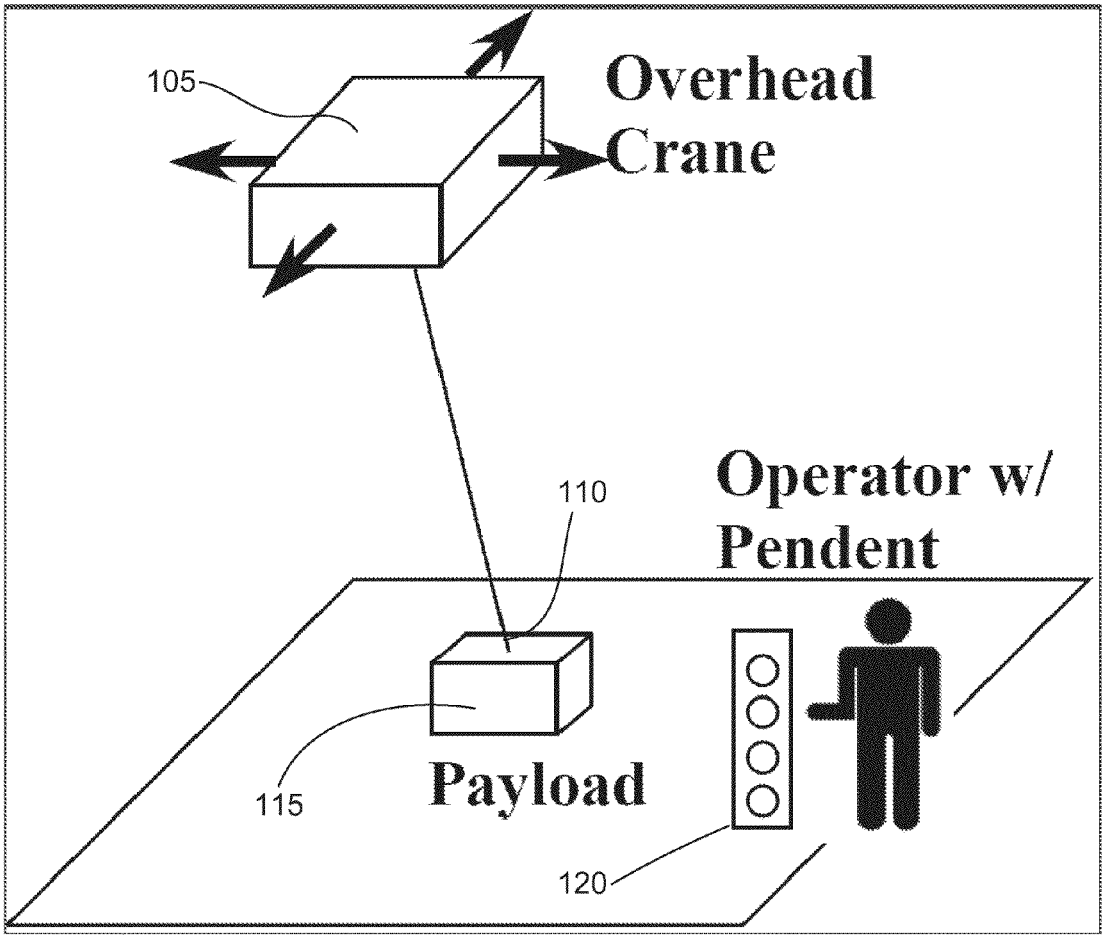
Prior Art Figure 1
FIG. 1 provides a conventional pendent crane control system.
Figure 2:
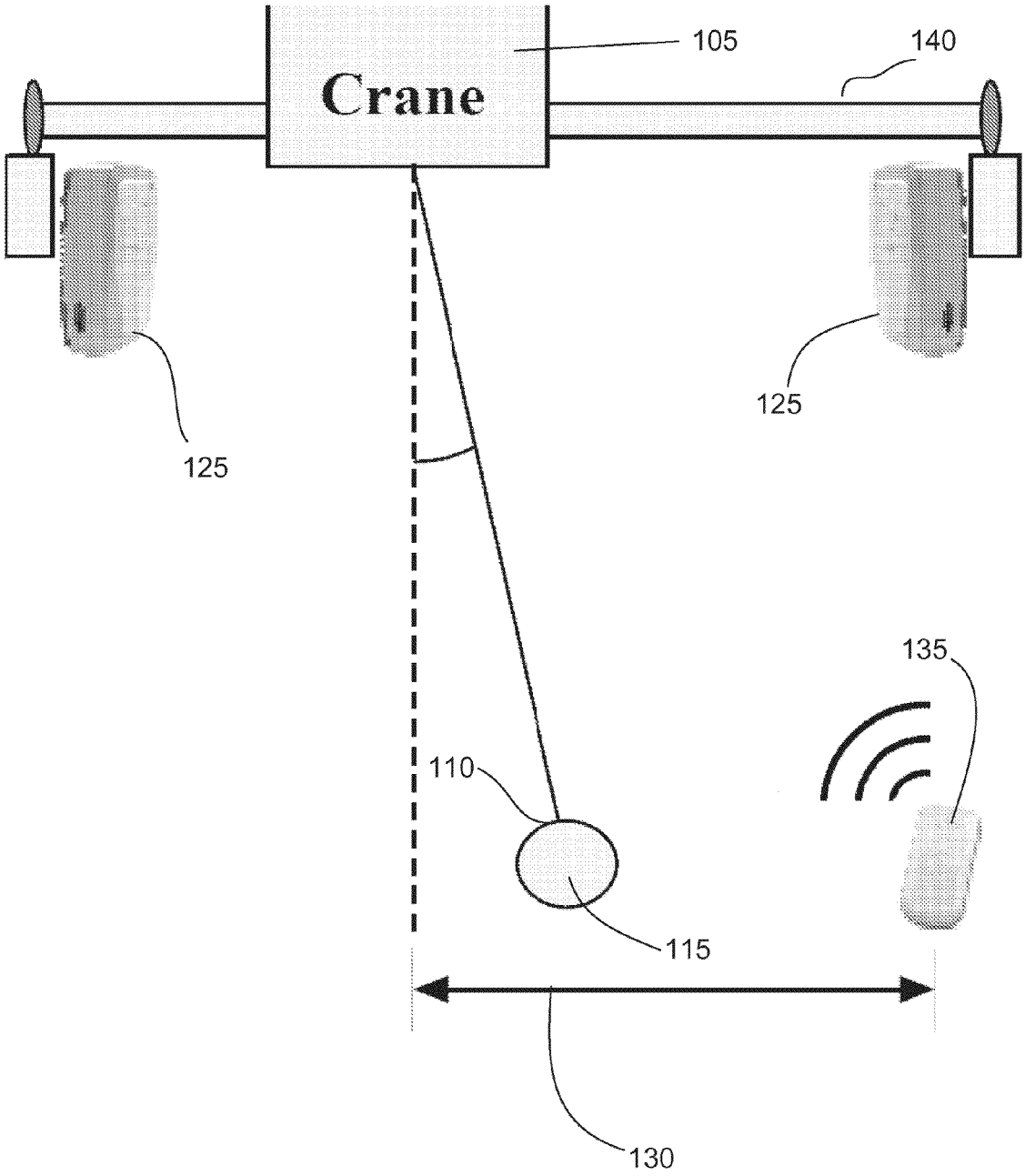
FIG. 2 provides a crane system controlled by an exemplary crane control system of the present invention.

Various embodiments of the present invention relate to crane control systems for controlling crane systems. As shown in FIG. 2, an exemplary crane system comprises a crane trolley 105 and a supporting device 110. The crane trolley 105 comprises a motor and is configured to move in multiple directions along rails 140 or other support structures. The supporting device 110 is in mechanical communication with the trolley 105 and is used for carrying a payload 115. The trolley 105 can raise and lower the supporting device 110 using hoist motors. The supporting device 110 can be any supporting structure known in the art or developed at a later time, including, but not limited to, a hook that can attach to a payload. Exemplary embodiments of the present invention provide crane control systems useful for simplifying crane system operation and for maintaining a safe distance between the payload 115 and a desired location, typically a region around a locator device 135, wherein the locator device 135 can be held by an operator. Thus, the invention provides superior operator safety. Some exemplary embodiments of the present invention provide crane control systems that manipulate at least one of the position and speed of the crane system, or individual components thereof. Additionally, some exemplary embodiments of the present invention also are useful in dampening payload oscillations when the crane trolley 105 is either accelerated or decelerated.

Figure 6:
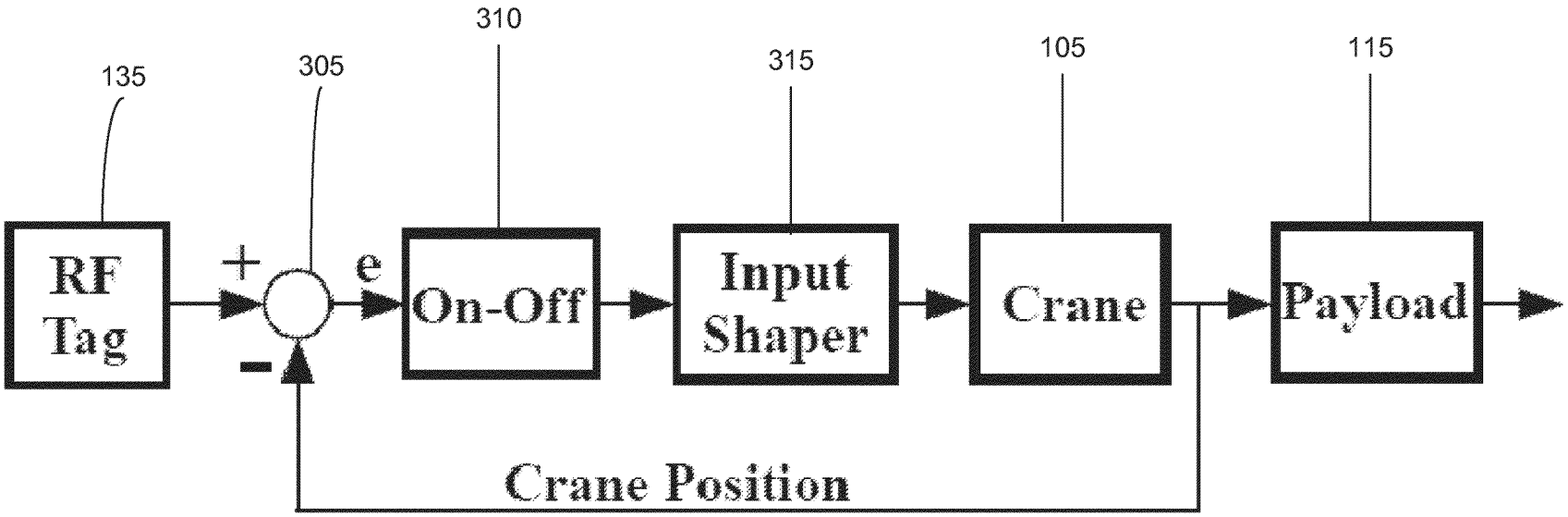
FIG. 6 provides a control block diagram for an exemplary crane control system of the present invention.

As shown in FIG. 6, an exemplary embodiment of the present invention provides a crane control system comprising a real-time position-location module 305, an on-off controller module 310, and an input-shaper module 315. The real-time position-location module 305 can generate a position signal indicative of a vector between an element of the crane system and a desired location (most typically a locator device 135). The vector between the element of the crane system and the desired location or locator device 135 can be indicative of the horizontal planar distance and vertical planar distance between the element of the crane system and the desired location or locator device 135. The element of the crane system can include, but is not be limited to, the crane trolley 105, the supporting device 110, or the payload 115. The locator device 135 can be many devices that can be used to create a position signal, including, but not limited to, a Radio-Frequency Identification ("RFID") tag, a SONAR device, a RADAR device, a Global Positioning System ("GPS") device, and the like. The locator device 135 can also be portable or stationary. In an exemplary embodiment of the present invention, the locator device 135 is a portable RFID tag that is carried around a workspace by an operator. The real-time position-location module 305 can measure many different distances between the element of the crane system and the locator device 135 (FIG. 2). In an exemplary embodiment, the position signal is indicative of the horizontal planar distance 130 between the crane trolley 105 and the locator device 135. The position signal can be used to manipulate at least one of the position and speed of the crane system, or components thereof. In some embodiments of the present invention, the real-time position location module 305 comprises instructions stored in memory and capable of implementation by a computer or controller.

Figure 14A:
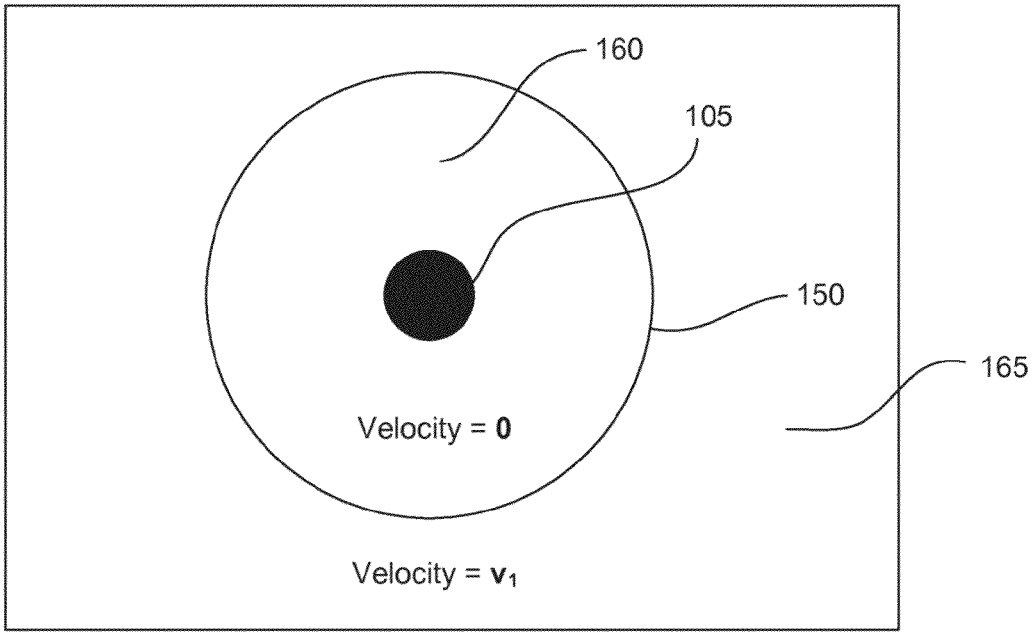
FIG. 14A illustrates crane trolley velocity when the velocity command signal is mapped in accordance with an exemplary embodiment of the present invention.
Figure 14B:
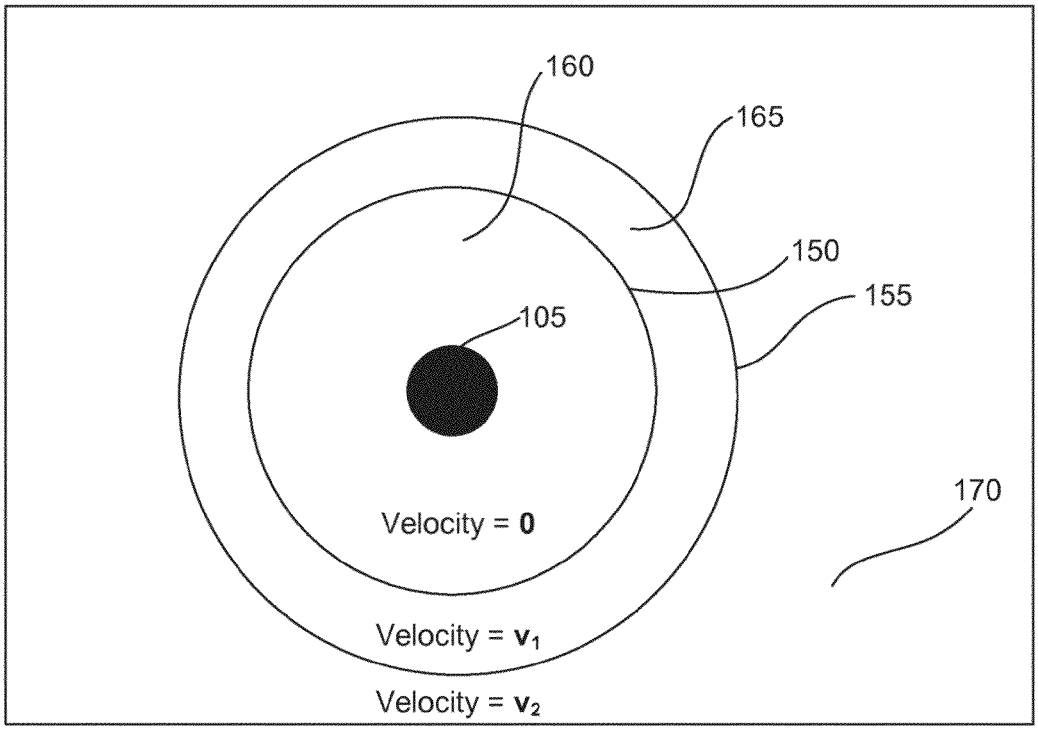
FIG. 14B illustrates crane trolley velocity when the velocity command signal is mapped in accordance with another exemplary embodiment of the present invention.

The on-off controller module 310 of the exemplary crane control system can map the position signal to a velocity command signal. The velocity command signal can comprise instructions for the crane trolley 105 to move the supporting device 110 in a vector relative to the locator device 135 in at least a first velocity only if the magnitude of the vector between an element of the crane system and the locator device 135 is greater than a cut-off threshold 150, wherein the at least a first velocity is substantially constant (FIG. 14A). Thus, in some embodiments, the crane trolley 105 will not move if the magnitude of the vector between the element of the crane system and the locator device 135 is less than or equal to the cut-off threshold 150, and will move in at least a substantially constant first velocity if the magnitude of the vector is greater than the cut-off threshold 150. In some embodiments of the present invention, the at least a first velocity is equal to the first velocity if the magnitude of the vector between the element of the crane system and the locator device 135 is greater than a cut off threshold and less than or equal to an intermediate threshold 155, and the at least a first velocity is equal to a second velocity greater than the first velocity if the magnitude of the vector between the element of the crane system and the locator device 135 is greater than the intermediate threshold 155 (FIG. 14B). Thus, in these embodiments, the crane trolley 105 has three discrete velocities. It will not move (velocity equal to zero) if the distance between the element of the crane system and the locator device 135 is less than or equal to the cut-off threshold 150. The crane trolley 105 will move at a first velocity if the distance is greater than the cut-off threshold 150 but less than or equal to the intermediate threshold 155. And, the crane trolley 105 will move at a second velocity if the distance is greater than the intermediate threshold 155. In these embodiments, if the second velocity is greater than the first velocity, the crane trolley 105 will move at a slower velocity when it is closer to the locator device 135 and a faster velocity when it is further away from the locator device 135. In some embodiments of the present invention, the on-off controller module 310 comprises instructions stored in memory and capable of implementation by a computer or controller.

Figure 15:
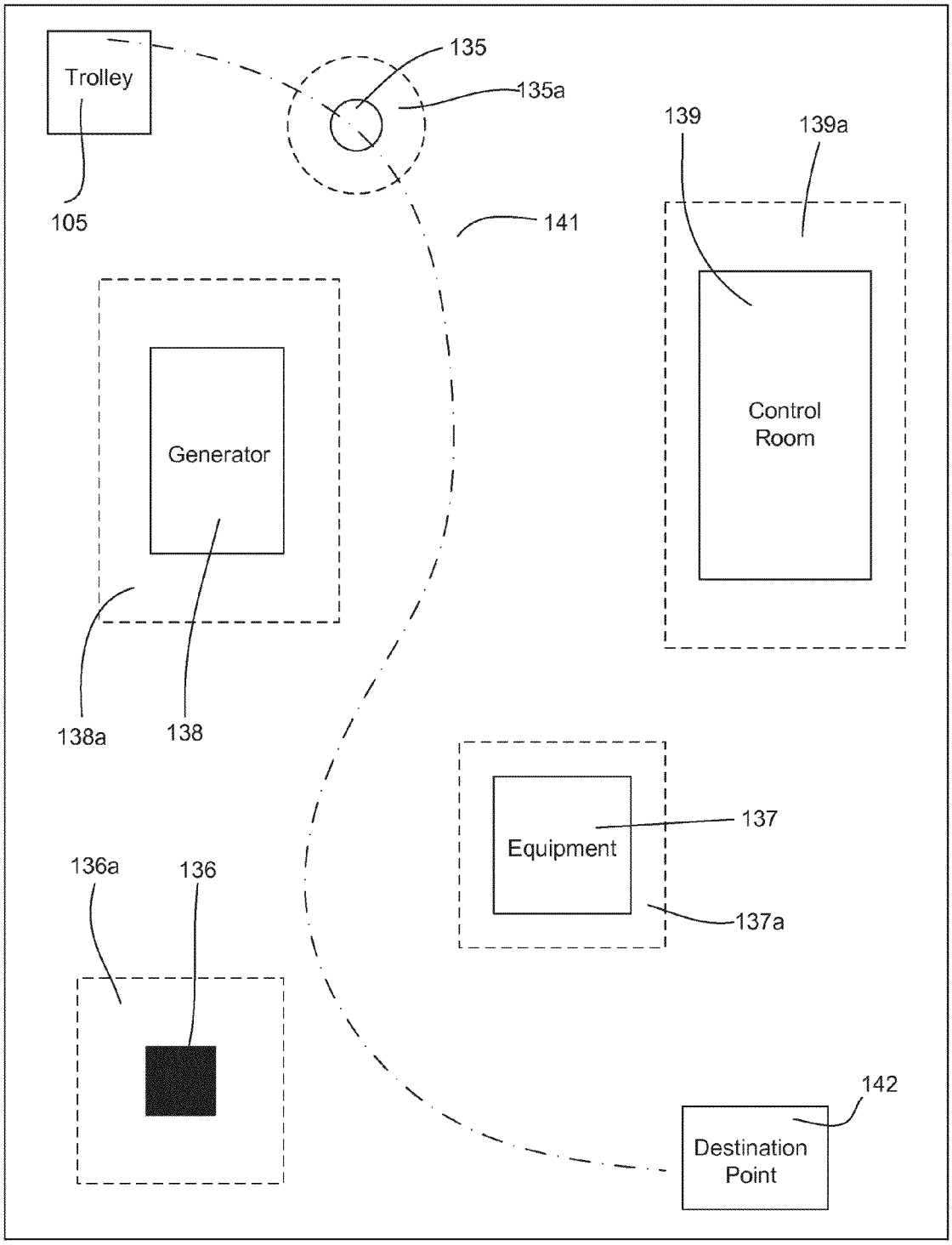
FIG. 15 illustrates operation of an crane control system in a power generation plant in accordance with an exemplary embodiment of the present invention.

The scope of the invention is not limited to a cut-off threshold 150 and an intermediate threshold 155 corresponding to a first velocity and a second velocity. Instead, the present invention can employ many different thresholds corresponding to many different velocities depending on the desired application. Additionally, some embodiments of the present invention may include a plurality of locator devices defining a plurality of desired locations of safety. For example, as shown in FIG. 15, the present invention may be applied to a crane system in a power generation plant. The power generation plant may have a control room 139, generator 138, concrete or steel columns 136, and other equipment 137, which may be damaged if struck by the payload 115. Similarly, the payload 115 may be damaged if it strikes the various components. An exemplary crane control system of the present invention allows an operator to move a payload 115 suspended from a crane trolley 105 around the power plant to a destination point 142 while avoiding from striking any of the components. To move the payload 115 to the destination point 142, the operator need only walk throughout the workspace in the path 141 the operator wishes the payload 115 to travel, and the payload 115 will follow the locator device 135 carried by the operator. A cut-off threshold defines a desired location of safety 135*a* around the locator device 135, such that the payload will not strike the operator. Each component 136, 137, 138, and 139 can also have a desired safety zone 136*a*, 137*a*, 138*a*, and 139*a* in which the payload will not enter. If the operator attempts to move payload 115 into any of the safety zones 136*a*, 137*a*, 138*a*, and 139*a*, the trolley 105 will stop moving. Each safety zone 136*a*, 137*a*, 138*a*, and 139*a* may be stored into a memory within the crane control system. Alternatively, safety zones 136*a*, 137*a*, 138*a*, and 139*a* can be defined by additional locator devices placed about each component 136, 137, 138, and 139, such that if the distance from the payload 115 to one of the locator devices on a component is less than a cut-off threshold for that particular locator device, the trolley 105 will stop moving. As an additional safety feature, workers around the workspace may each carry locator devices, such that if the distance between the payload 115 and the locator device carried by a worker is less than a cut-off threshold, the trolley 105 will stop moving, thus ensuring workers are not struck by the payload 115. When multiple locator devices are used, the locator device 135 carried by the operator is used to control the direction of the trolley's 105 movement. Additionally, because some embodiments of the present invention uses multiple thresholds, e.g. a cut-off threshold and an intermediate threshold, the trolley 105 will move faster when it is further away from the operator or safety zones 136*a*, 137*a*, 138*a*, and 139*a* (greater than an intermediate threshold), and the trolley 105 will move slower when it is closer to the operator or safety zones 136*a*, 137*a*, 138*a*, and 139*a* (greater than a cut-off threshold and less than an intermediate threshold).

The various embodiments of the present invention are not limited in moving the payload or supporting device 110 in a horizontal sense, but instead, some embodiments of the present invention allow an operator to control the vertical movement of the supporting device 110, and thus the payload 115. Thus, in some embodiments of the present invention, the velocity command signal can comprise instructions for the crane trolley to move an element of the crane system, most typically the supporting device 110, in a vector—horizontal, vertical, or a combination thereof—relative to the locator device 135. In some embodiments of the present invention, the velocity command signal can comprise instructions for the crane trolley to raise and lower the supporting device 110, and thus the payload 115, in a vertical direction.

In an exemplary embodiment of the present invention, the position signal is indicative of the vector between an element of the crane system and the desired location of safety, most typically the locator device 135. Thus, if the locator device 135 is raised or lowered by the operator, such that the magnitude of the vertical component of the vector is greater than a cut-off threshold, the velocity command signal will comprise instructions for the crane trolley 105 to raise or lower the supporting device 110 in a vector relative to the locator device 135. In another exemplary embodiment of the present invention, the locator device 135 comprises operator input elements, such that an operator input may be used to control the vertical movement of the supporting device 110. As those skilled in the art would recognize, the operator input elements may be many operator input elements known in the art or developed at a later time, including, but not limited to, buttons, switches, joysticks, levers, and the like.

In some embodiments of the present invention, an operator may make "gesture-like" movements with the locator device 135, such that the position, velocity, or acceleration of the locator serve as the basis to raise and lower the supporting device 110. For example, and not limitation, to raise the supporting device 110, the operator could: move the locator device 135 from a lower position to a higher position—a position-based gesture; move the locator device 135 at a constant speed upwards—a velocity-based gesture; or accelerate quickly, or "flick," the locator 135 device upwards—an acceleration-based gesture.

The input shaper module 315 can manipulate the velocity command signal mapped by the on-off controller module 310 to dampen payload oscillations or supporting device oscillations when the crane trolley 105 is accelerated or decelerated. In some embodiments of the present invention, the input shaper module 315 comprises instructions stored in memory and capable of implementation by a computer or controller. In some embodiments of the present invention, the input shaper module 315 manipulates the velocity command signal by convolving a baseline input command with a series of impulses at specific time intervals, thus resulting in a shaped command that will reduce residual vibration. In order to determine the impulses amplitudes and time locations for the input shaper module 315, some embodiments of the present invention satisfy certain design constraints. One such design constraint can be a limit on the amplitude of vibration caused by the input shaper module 315. In some embodiments, the Normalized Residual Vibration ("NRV") amplitude of an under-damped, second-order system from a sequence of n impulses is represented by Equation 1:

$$\mathrm{NRV}=V(\omega,\zeta)=e^{-\zeta\omega t_n}\sqrt{[C(\omega,\zeta)]^2+[C(\omega,\zeta)]^2} \qquad \text{Equation 1:}$$

where $C(\omega, \zeta)$ can be defined by Equation 2, and $S(\omega,\zeta)$ can be defined by Equation 3:

$$C(\omega, \zeta) = \sum_{i=1}^{n} A_i e^{\zeta\omega t_i} \cos\left(\omega t_i \sqrt{1-\zeta^2}\right) \qquad \text{Equation 2}$$

$$S(\omega, \zeta) = \sum_{i=1}^{n} A_i e^{\zeta\omega t_i} \sin\left(\omega t_i \sqrt{1-\zeta^2}\right) \qquad \text{Equation 3}$$

where $\omega$ is the natural frequency of the crane system, $\zeta$ is the damping ratio, and $A_i$ and $t_i$ are the $i^{th}$-impulse amplitude and time, respectively. Equation 1 can give the ratio of vibration with input shaping to that without input shaping.

In some embodiments of the present invention, a constraint on residual vibration amplitude can be formed by setting Equation 1 less than or equal to a tolerable level of residual vibration at the modeled natural frequency and damping ratio. In an exemplary embodiment of the present invention, the input shaping module 315 is a Zero Vibration ("ZV") input shaping module, such that the tolerable amount of vibration is set to zero. This can result in the shaper illustrated in Equation 4:

$$ZV = \begin{bmatrix} A_i \\ t_i \end{bmatrix} = \begin{bmatrix} \frac{1}{1+K} & \frac{K}{1+K} \\ 0 & \frac{\pi}{\omega\sqrt{1-\zeta^2}} \end{bmatrix} \quad \text{Equation 4}$$

where K is represented by Equation 5.

$$K = e^{\frac{-\zeta\pi}{\sqrt{1-\zeta^2}}} \quad \text{Equation 5}$$

In some embodiments of the present invention, a crane control system comprises a real-time position-location subsystem. In some embodiments of the present invention, the real-time position-location subsystem comprises a locator device 135. The locator device 135 can be a portable locator device. In some embodiments, the locator device is configured to emit RF signals. In some embodiments, the locator device is configured to emit UWB RF signals. In some embodiments, the RF signals are emitted in response to an input, such as pushing a button, actuating a switch, receiving an input control system, and the like. The real-time position-location subsystem can also comprise a plurality of sensors 125. The plurality of sensors 125 can be placed around the perimeter of a workspace. In some embodiments of the present invention, the perimeter of the workspace can be defined by all possible locations in which the crane trolley 105 can travel. The plurality of sensors 125 can receive the signals emitted by the locator device 135. The real-time position location subsystem can comprise a real-time position-location module 305. The real-time position-location module 305 can calculate the three dimensional location of the locator device 135. In some embodiments, the real-time position-location module 305 calculates the three dimensional location of the locator device 135 using the time difference and angle of arrival of the RF signals at the plurality of sensors 125. The real-time position-location module 305 can then use the position of the locator device 135 relative to an element of the crane system to generate a position signal.

The cut-off threshold 150 and/or intermediate threshold 155 can be determined numerous ways in various embodiments of the present invention. In an exemplary embodiment of the present invention, the cut-off threshold 150 and/or the intermediate threshold 155 is determined as a function of the acceleration and/or deceleration properties of the crane trolley 105. Thus, in some embodiments, if the crane trolley 105 decelerates slowly, the cut-off threshold 150 can be increased to ensure that the payload 115 or supporting device 110 does not strike the locator device 135, or operator thereof. In another exemplary embodiment of the present invention, the cut-off threshold 150 and/or the intermediate threshold 155 can be determined as a function of parameters of the payload 115, including, but not limited to, the weight, length, width, height, geometrical shape, and material of the payload 115. For example, in some embodiments of the present invention, if the payload 115 extends one meter outward in a direction from the supporting device 110, then the cut-off threshold 150 may be set to greater than one meter in that direction to ensure the payload 115 does not strike the locator device 135, or operator thereof. An yet another exemplary embodiment of the present invention, the cut-off and/or intermediate threshold 155 can be determined in conjunction with properties of the input shaper module 315. Thus, for example, in some embodiments of the present invention, if the input shaper module 315 is more aggressive or longer, the cut-off threshold 150 may be higher to give the crane trolley 105 adequate time to stop, thus ensuring that the payload 115 or supporting device 110 does not strike the locator device 135, or operator thereof. In still yet another exemplary embodiment of the present invention, the cut-off threshold 150 and/or intermediate threshold 155 can be determined as a function of a vector position—horizontal, vertical, or a combination thereof—of the locator device 135 with respect to the crane trolley 105. Thus, in some embodiments of the present invention, the cut-off threshold 150 can be different values for different directions relative to the locator device 135, i.e. a geometrically-shaped, such as a rectangular-shaped or square-shaped, cut-off zone may be created by changing the cut-off threshold 150 depending on the direction of the locator device 135 relative to an element of the crane system.

FIG. 2 provides an exemplary crane system adapted to be controlled by an exemplary embodiment of the present invention. The crane system comprises a crane trolley 105 and supporting device 110 suspended from the trolley in a pendulum-like matter and carrying a payload 115. An exemplary crane control system uses a real-time position location module 305 to generate a position signal indicative of the horizontal planar distance 130 between the locator device 135, which is an RFID tag, and the crane trolley 105. The locator device 135 emits RF signals that are received by a plurality of sensors 125 located about a perimeter of a workspace. An on-off controller module 310 maps the position signal to a velocity command signal. If the horizontal planar distance 130 is less than or equal to a cut-off threshold 150, the velocity command comprises instructions for the crane trolley 105 to exhibit a zero velocity. If the horizontal planar distance 130 is greater than a cut-off threshold 150, then the velocity command comprises instructions for the crane trolley 105 to move in a vector relative to the locator device 135 in at least a first velocity. The crane trolley 105 can continue to move in at least a first velocity so long as the horizontal planar distance 130 is greater than the cut-off threshold 150. Thus, an operator may hold the locator device 135 and move it around the workspace, and the payload 115 will follow the locator device 135 so long as the horizontal planar distance 130 is greater than the cut-off threshold 150.

Figure 3:
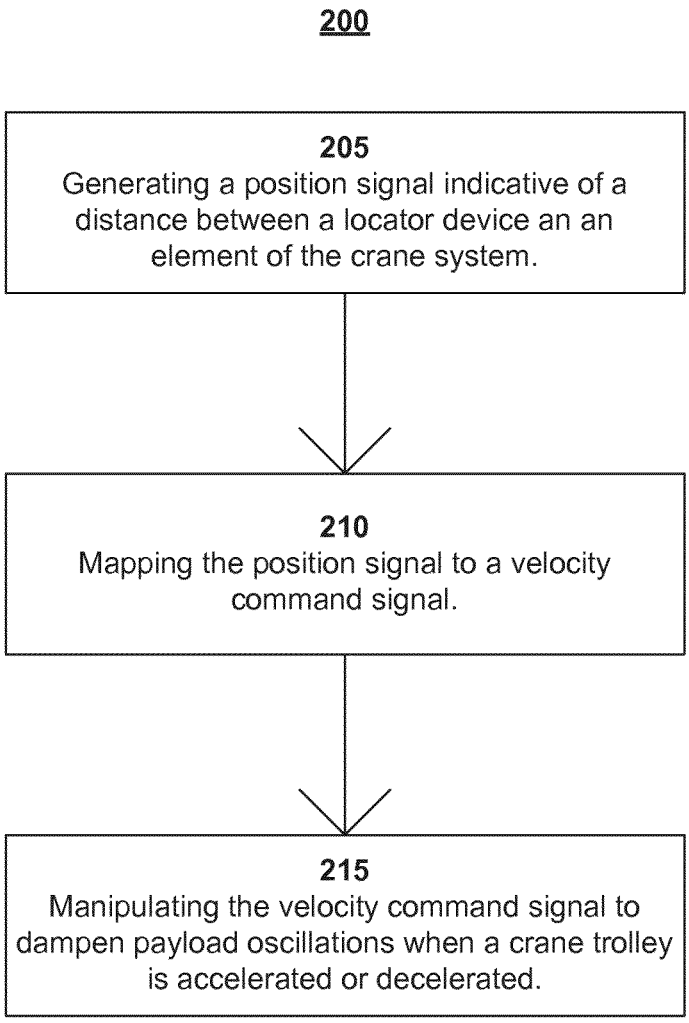
FIG. 3 provides a block diagram of a method of controlling a crane system in accordance with an exemplary embodiment of the present invention.

In addition to crane control systems, the present invention provides methods of controlling a crane system. FIG. 3 provides a block diagram of a method of controlling a crane system 200 in accordance with an exemplary embodiment of the present invention. An exemplary method of controlling a crane system 200 comprises generating a position signal indicative of a vector between a desired location, most typically a locator device 135, and an element of the crane system 205, mapping the position signal to a velocity command signal 210, and manipulating the velocity command signal to dampen payload oscillations when the crane trolley 105 is accelerated or decelerated 215. The velocity command signal can comprise instructions for the crane trolley 105 to move the supporting device 110 in a vector relative to the locator device 135 in at least a first velocity only if the magnitude of the vector between the element of the crane system and the locator device 135 is greater than a cut-off threshold 150.

Figure 4:
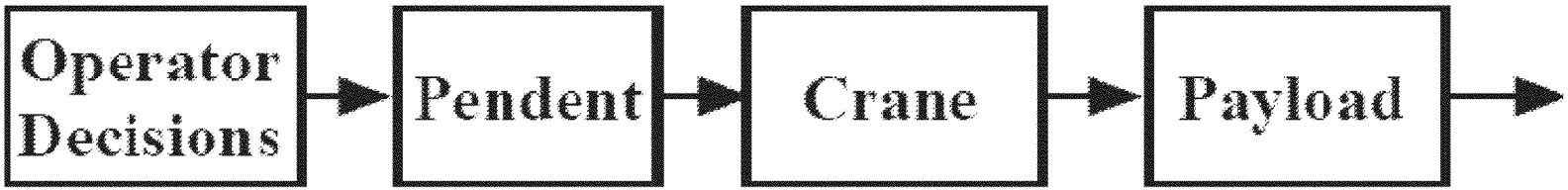
FIG. 4 provides a block diagram for a pendent crane control system.
Figure 7:
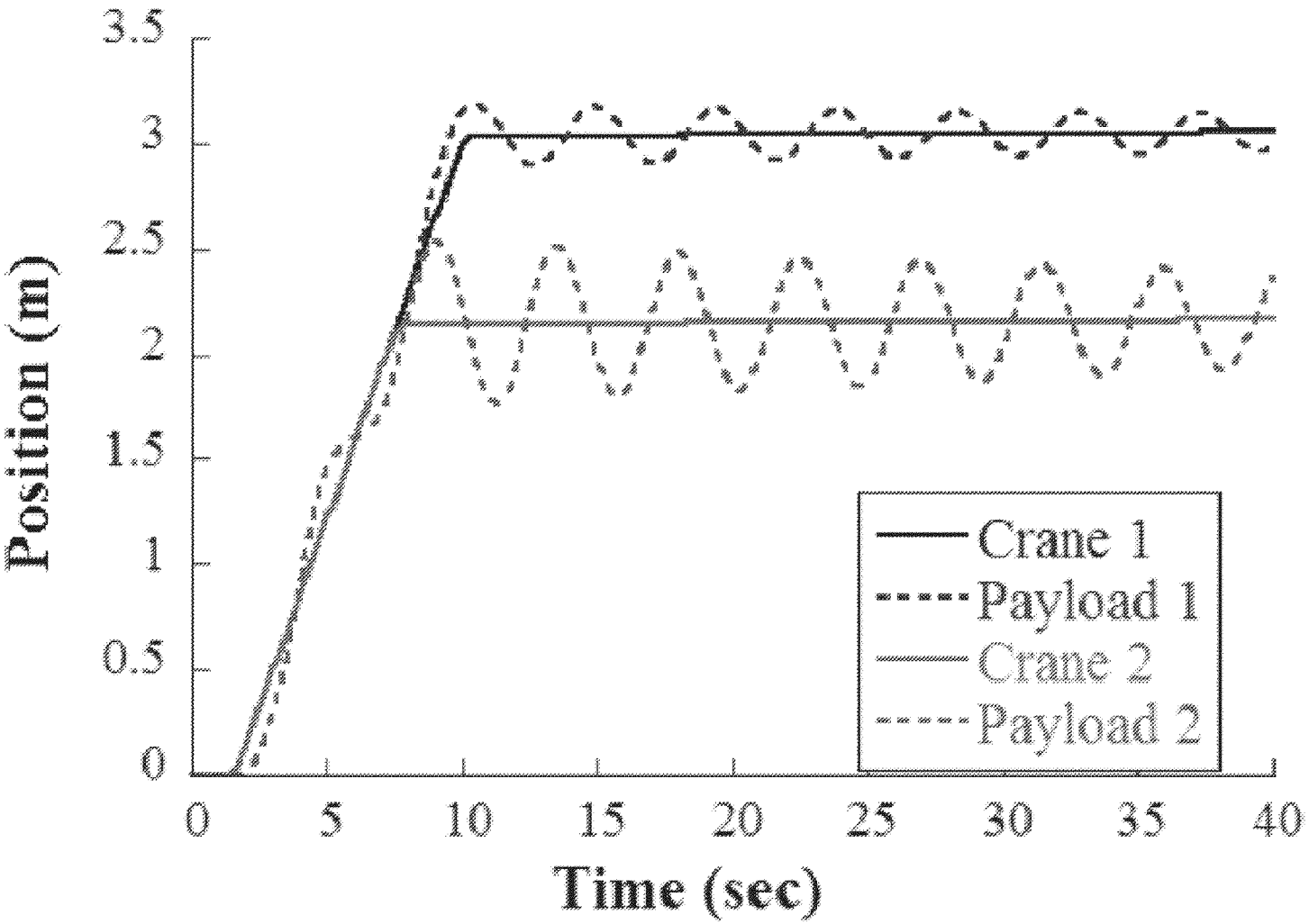
FIG. 7 provides a graphical illustration of the position of a crane and payload with respect to elapsed time during two meter and three meter point-to-point movements using a pendent crane control system.

Embodiments of the present invention provide many improvements over pendent, Proportional Derivative ("PD") feedback, and Proportional ("P") feedback crane control systems. A block diagram for a pendent crane control system is illustrated in FIG. 4. In this system, a crane operator is required to analyze the workspace, consider the required manipulation goal, and then decide on a course of action. This plan is then implemented by pushing buttons on the control pendent. These buttons energize the motors to move the overhead crane at constant velocity. When a button is released, the crane will stop. Due to the pendulum-like nature of the payload, this type of movement will, in general, induce significant residual oscillations. FIG. 7 provides a graphical illustration of the position of a crane and payload with respect to elapsed time during two meter and three meter point-to-point movements using the pendent crane control system. It is clear that the oscillatory position of the payload is extreme, and could be very dangerous to both the payload and anyone or anything in proximity to the payload.

Figure 5:
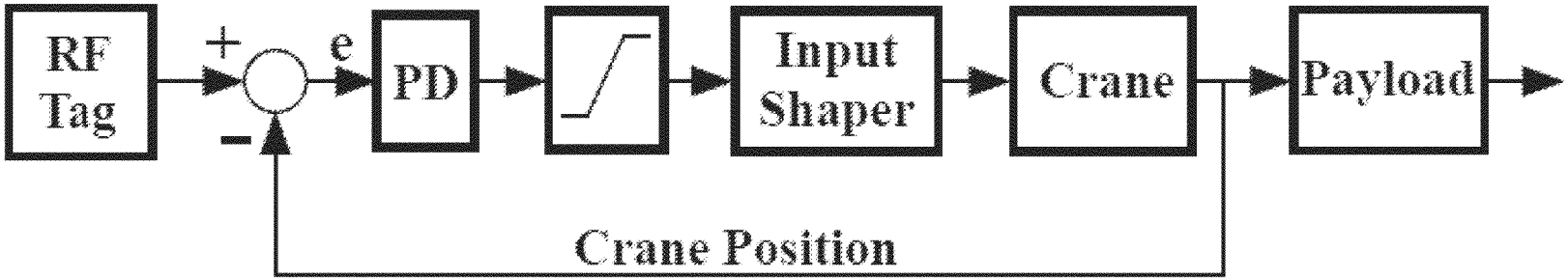
FIG. 5 provides a block diagram for a PD feedback crane control system.

A block diagram for a PD feedback crane control system is illustrated in FIG. 5. The position of an RFID tag is compared to the position of the crane trolley to generate an error signal, e. This position error signal is first mapped into a non-constant velocity command signal as shown in Equation 6.

$$\text{Command} = \begin{cases} 0\%: \ e \le e_{min} \\ 100\% \times \dfrac{e - e_{min}}{e_{max} - e_{min}}: \ e_{min} < e < e_{max} \\ 100\%: \ e \ge e_{max} \end{cases} \qquad \text{Equation 6}$$

A PD feedback control law is then applied and the result is passed through a saturator to ensure that velocity and acceleration limits are not exceeded. This output is then modified by an input shaper so that the command signal sent to the crane will not excite payload swing.

Although the PD crane control system reduces payload swing, there are several drawbacks to such systems. By choosing an aggressive P gain, the crane is able to closely tack the movement of the tag. Aggressive P gains, however, result in high amplitude payload sway. Conversely, increasing the D gain increases damping to smooth out aggressive commence, but at the cost of sluggish crane movements. Therefore, the inclusion of an input shaper inside the feedback loop is used in an attempt to limit or eliminate residual oscillations, while allowing high P gains such that the crane follows the tag aggressively. The crane itself, however, still responds in an oscillatory manner, which is separate from the oscillating payload. Thus, these conventional systems present an inherent trade-off between following the tag in an aggressive manner and system settling time.

Figure 8:
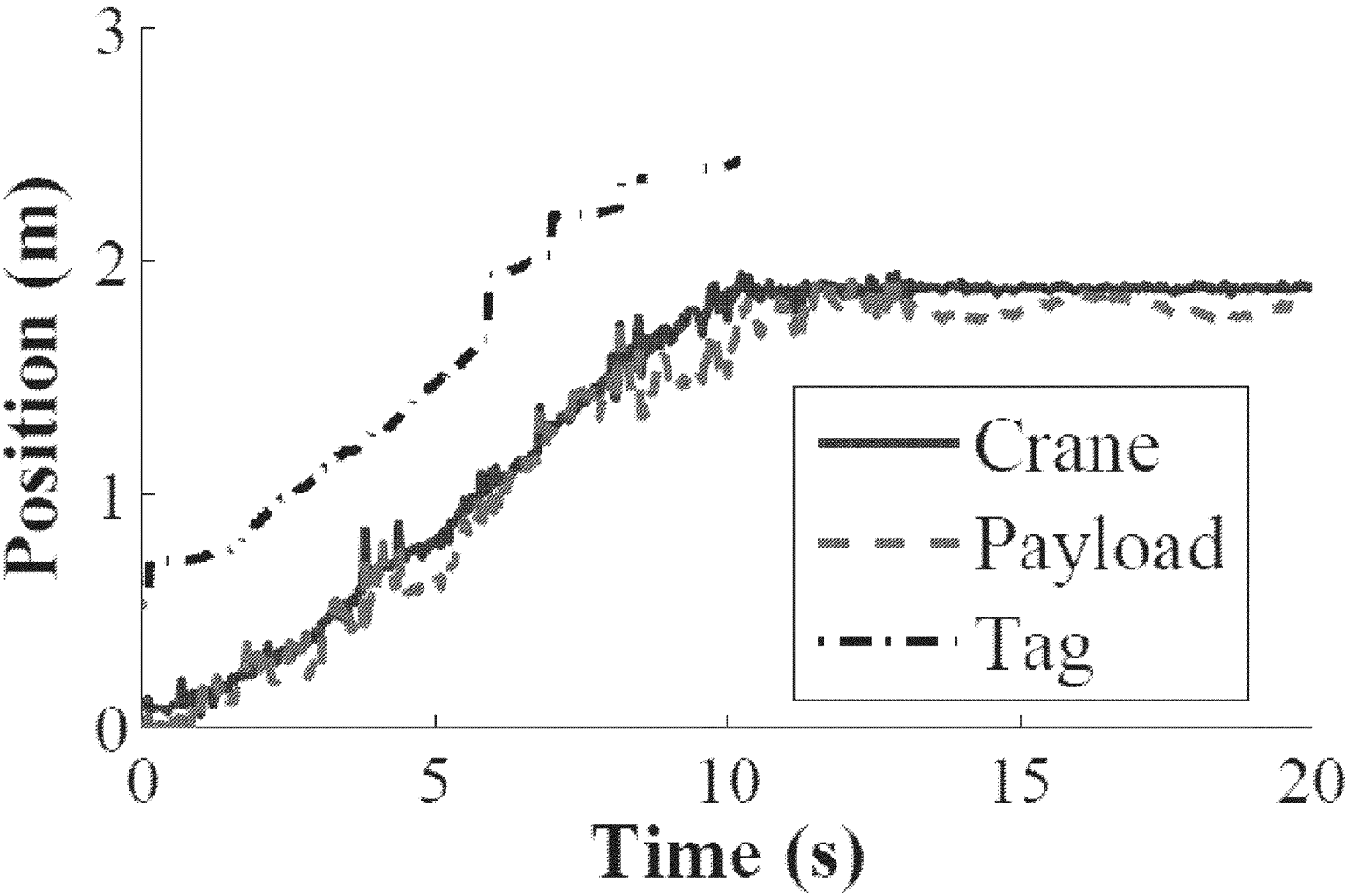
FIG. 8 provides a graphical illustration of the position of a crane, payload, and tag with respect to elapsed time during a two meter point-to-point movement using a PD crane control system.
Figure 9:
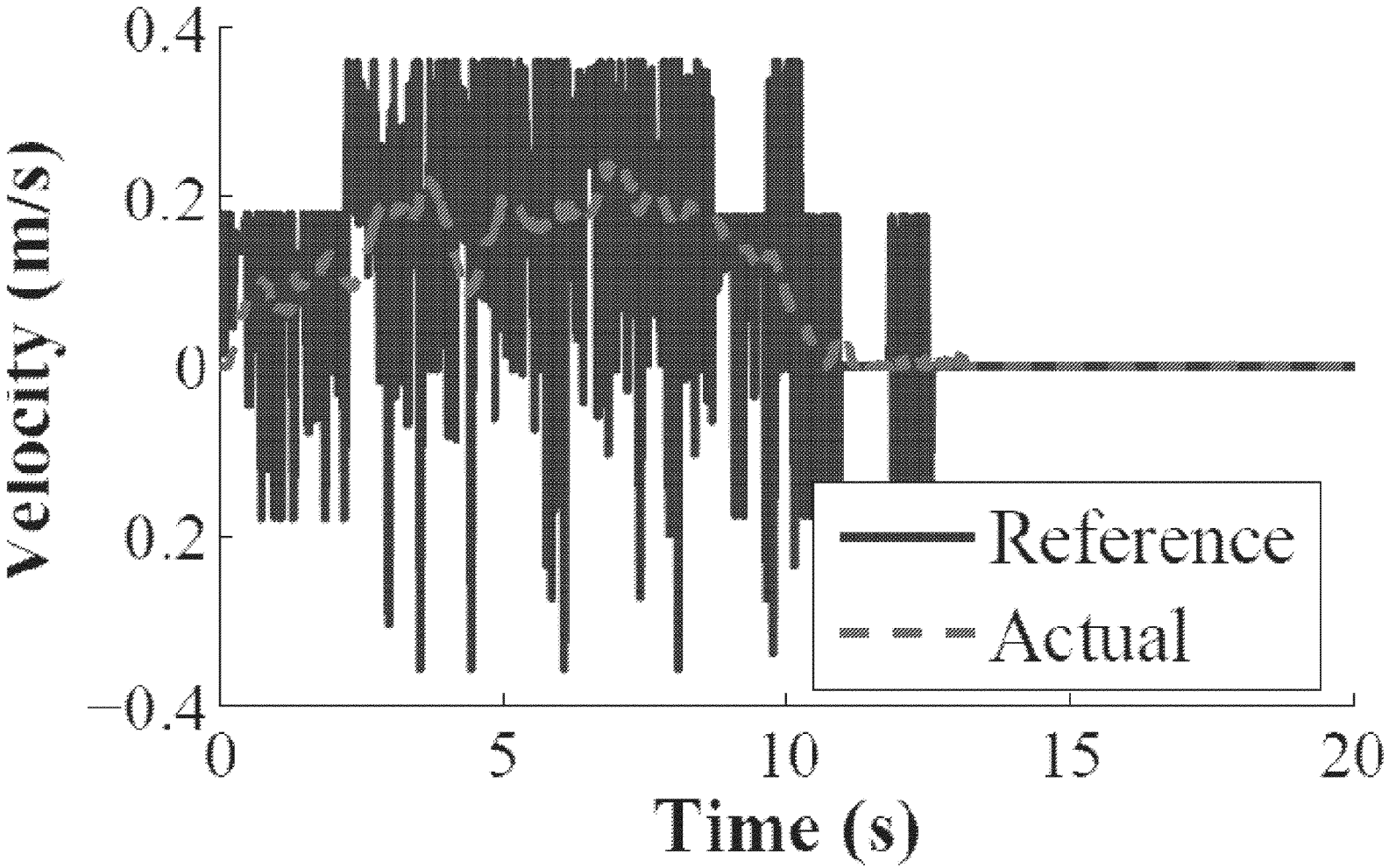
FIG. 9 illustrates the velocity-to-time command signal and the actual velocity-to-time response during a two meter point-to-point movement with a PD crane control system.

FIG. 8 provides a graphical illustration of the position of a crane, payload, and tag with respect to elapsed time during a two meter point-to-point movement using a PD crane control system. The control system design parameters were chosen by trial and error to produce the most satisfactory performance in terms of rise time and settling time. In the experimental point-to-point movement represented in FIG. 8, it took the crane and payload approximately ten seconds to reach the desired position. In addition to the lengthy time requirement for the conventional PD crane control system, significant issues with noisy signals arise. Because there is significant signal noise in both the tag and crane positions, as shown in FIG. 8, the error signal will also be noisy. When PD is applied to the error, the noise is amplified (principally due to the derivative component). Subsequently, the reference velocity command to the motors contains many high frequency spikes, as illustrated by FIG. 9. Due to the inertia of the crane, however, the crane acts as a low pass filter and is incapable of following the fast-switching reference velocity. Nevertheless, high frequency components are still undesirable because they may excite unmodeled higher modes, such as a trolley rock phenomenon. This phenomenon is responsible for the residual payload oscillations in FIG. 8.

Figure 10:
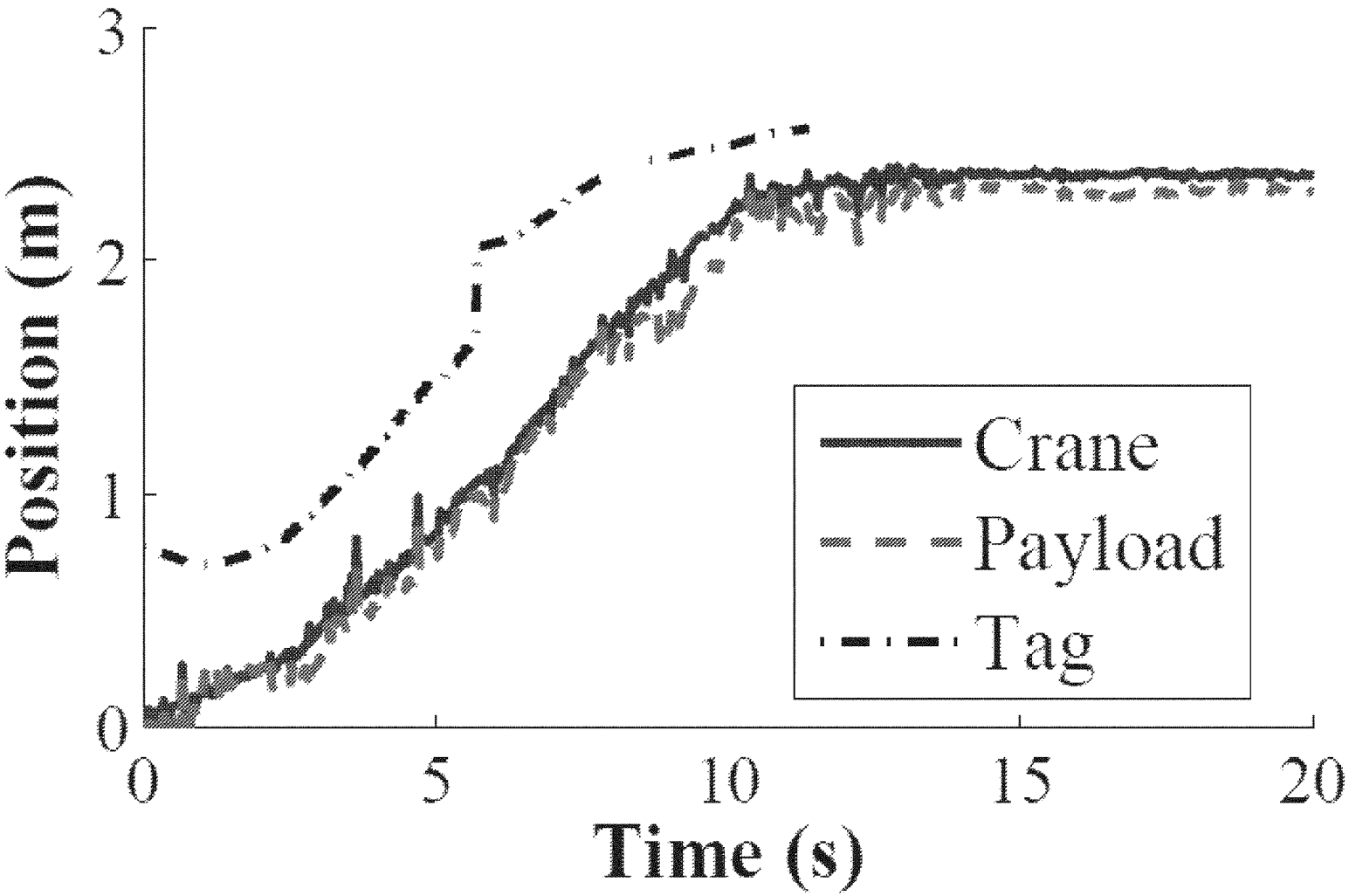
FIG. 10 provides a graphical illustration of the position of a crane, payload, and tag with respect to elapsed time during a two meter point-to-point movement using a P crane control system.
Figure 11:
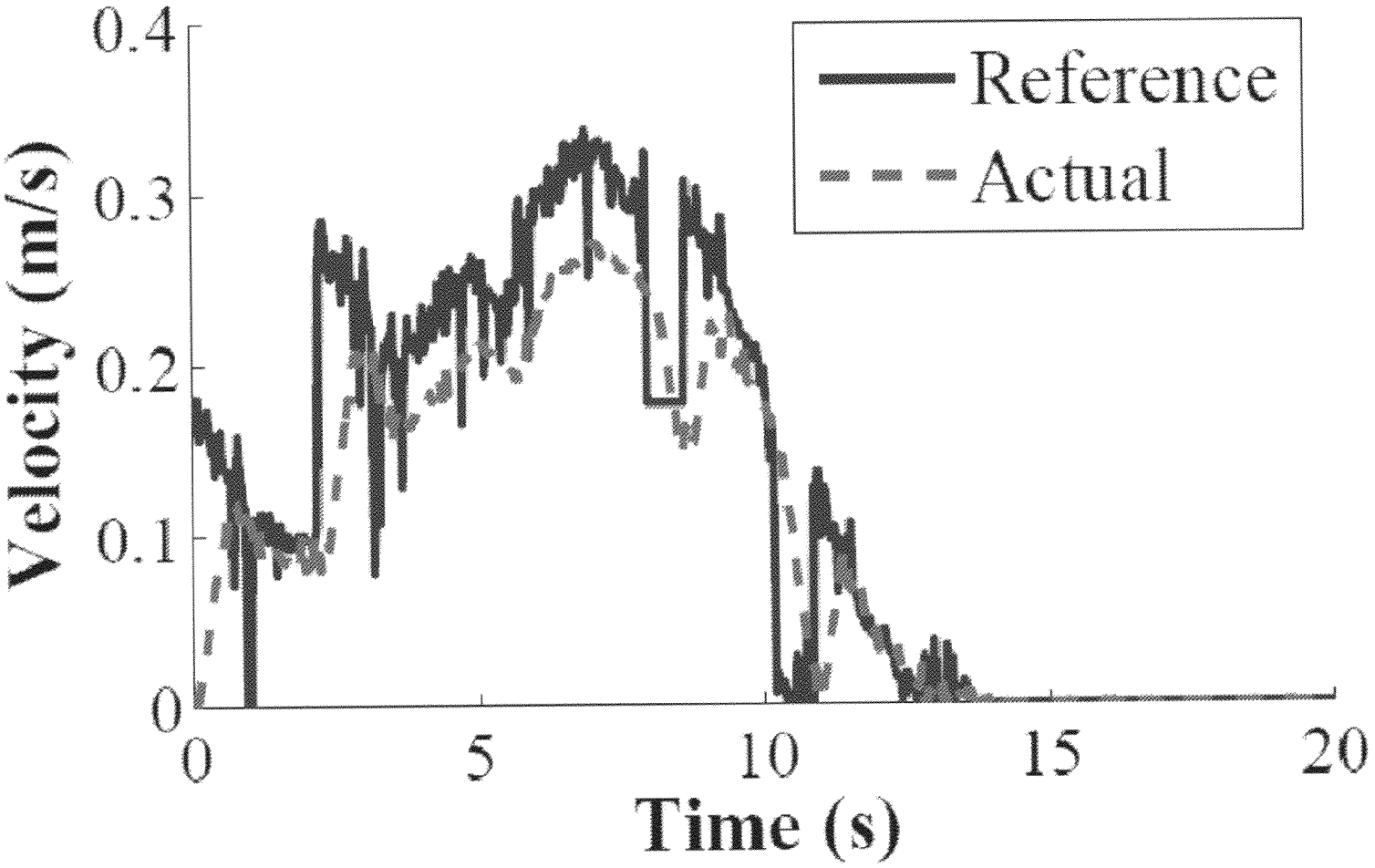
FIG. 11 illustrates the velocity-to-time command signal and the actual crane velocity-to-time response during a two meter point-to-point movement with a PD crane control system.

To attempt to alleviate some of the problems with PD crane control systems, some systems set the derivative component to zero. FIG. 10 provides a graphical illustration of the position of a crane, payload, and tag with respect to elapsed time during a two meter point-to-point movement using this P crane control system. FIG. 11 illustrates the velocity-to-time response during the same two meter point-to-point movement with the P crane control system. While the command signal contains less noise than the PD crane control system, it still takes ten seconds to move two meters. Further, the noise in the reference command signal prevents the crane from making sustained movements at maximum velocity. Thus, in FIGS. 9 and 11, the crane never reaches a desired maximum velocity.

FIG. 6 provides a control block diagram for an exemplary crane control system of the present invention. The exemplary embodiment does not use the PD or saturator blocks like conventional systems. Instead, the exemplary crane control system comprises an on-off controller module 310. In an exemplary embodiment of the present invention, the on-off controller module 310 maps a position signal, e, to a velocity command signal as indicated in Equation 7.

$$\text{Command} = \begin{cases} 0: \ e \le e_{cut-off} \\ v_1: \ e > e_{cut-off} \end{cases} \qquad \text{Equation 7}$$

FIG. 14A illustrates crane trolley velocity when the velocity command signal is mapped using Equation 7 in accordance with an exemplary embodiment of the present invention. When the locator device 135 is in the cut-off-zone 160, i.e. the position signal is less than or equal to a cut-off threshold 150, $e_{cut-off}$, then the velocity command signal is set to zero, and when the locator device in the $v_1$-zone 165, i.e. the position signal is greater than the cut-off threshold 150, then the velocity command is set to a first velocity, $v_1$. Additionally, in some embodiments, when the position signal is greater than the cut-off threshold 150, the velocity command is set to at least a first velocity.

In another exemplary embodiment of the present invention, the on-off controller maps a position signal to a velocity signal as indicated in Equation 8.

$$\text{Command} = \begin{cases} 0: \ e \le e_{cut-off} \\ v_1: \ e_{cut-off} < e \le e_{int} \\ v_2 \ e > e_{int} \end{cases} \qquad \text{Equation 8}$$

FIG. 14B illustrates crane trolley velocity when the velocity command signal is mapped using Equation 8 in accordance with an exemplary embodiment of the present invention. When the locator device 135 is in the cut-off-zone 160, i.e. the position signal is less than or equal to a cut-off threshold 150, then the velocity command signal is set to zero. When the locator device 135 is in the $v_1$-zone, i.e. the position signal is greater than the cut-off threshold 150 but less than or equal to an intermediate threshold 155, $e_{int}$, then the velocity command signal is set to a first velocity. Finally, when the locator device 135 is in the $v_2$-zone, i.e. the position signal is greater than the intermediate threshold 155, then the velocity command signal is set to a second velocity.

Figure 12:
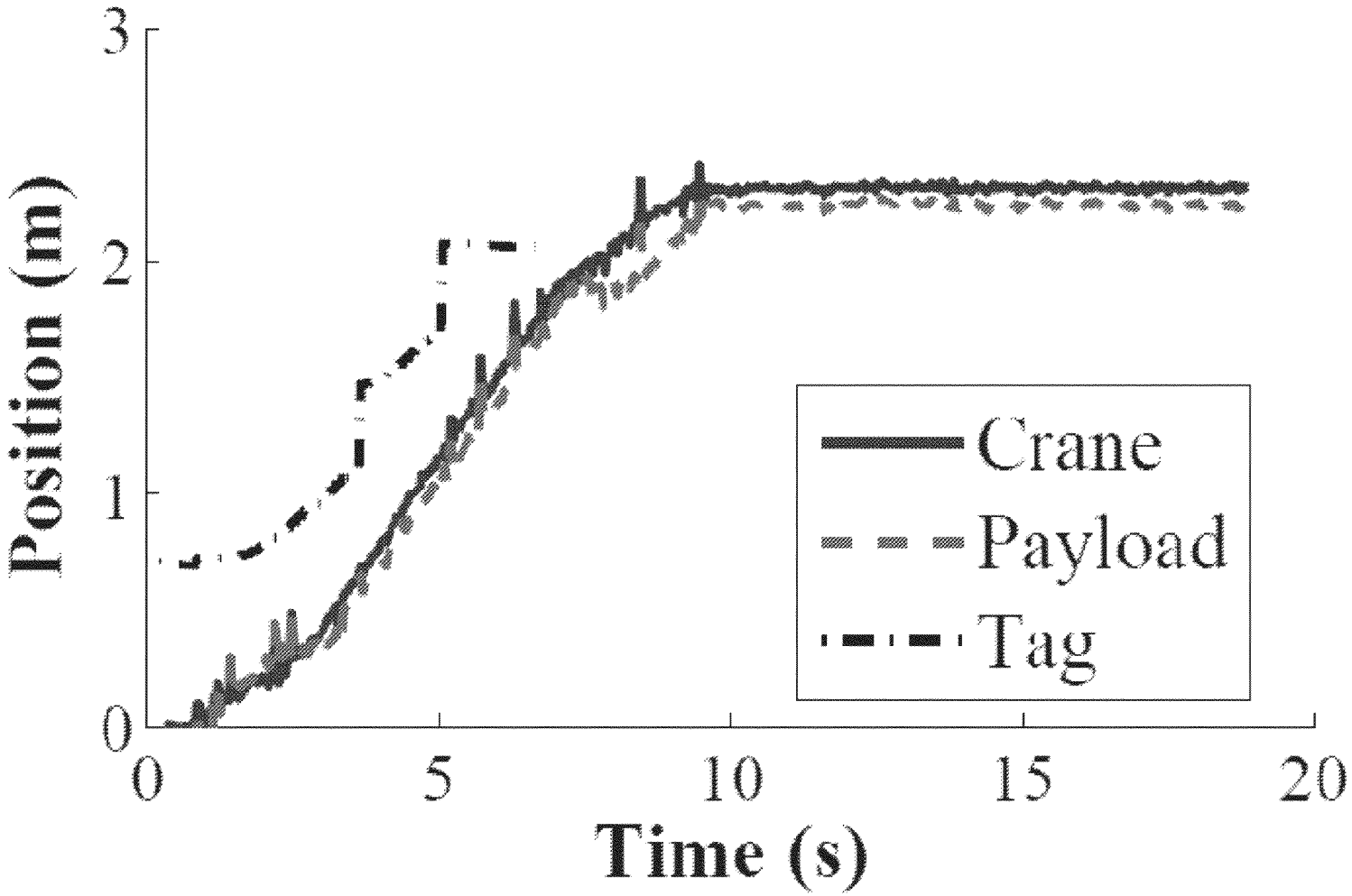
FIG. 12 provides a graphical illustration of the position of a crane, payload, and tag with respect to elapsed time during a two meter point-to-point movement using a crane control system in accordance with an exemplary embodiment of the present invention.
Figure 13:
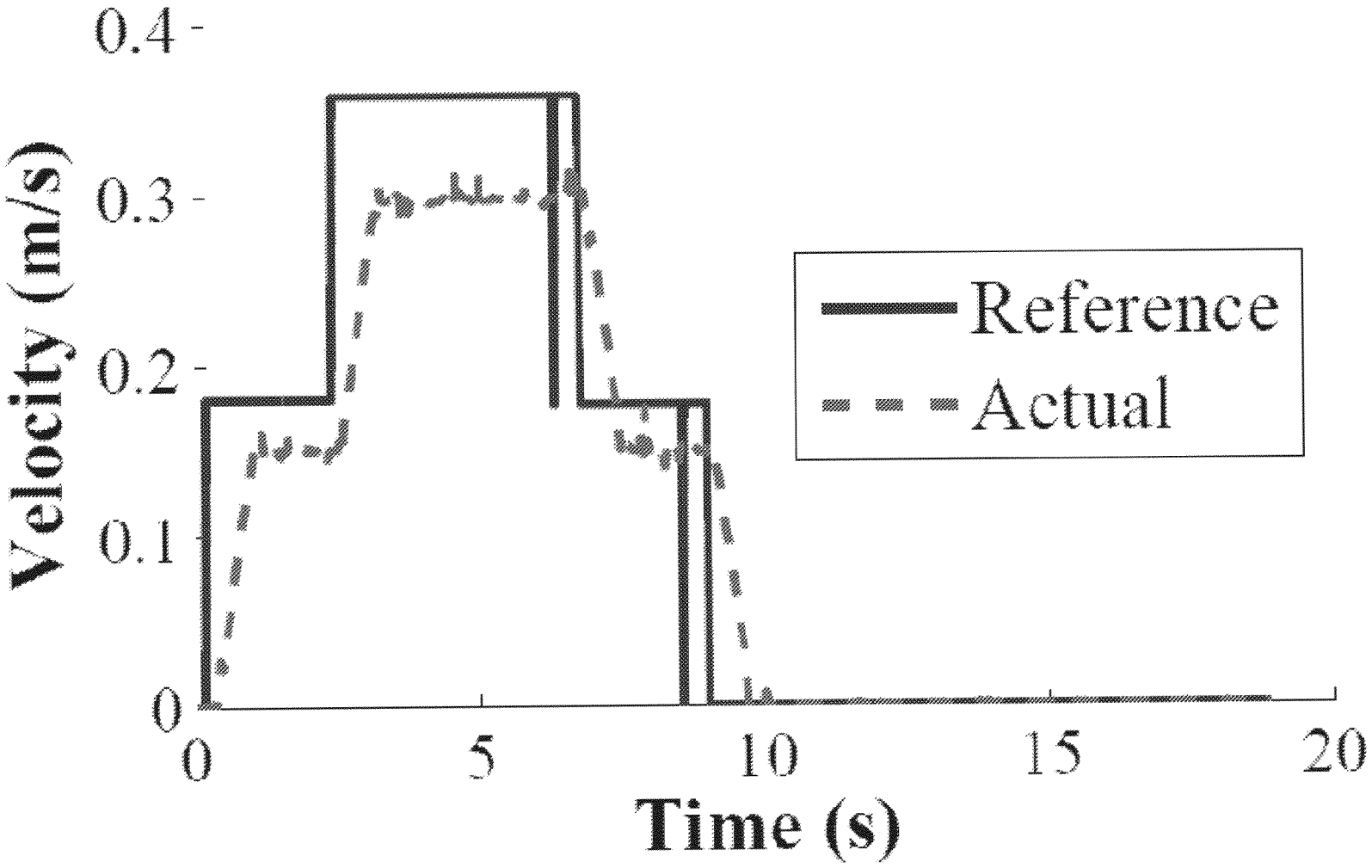
FIG. 13 illustrates the velocity-to-time command signal and the actual crane velocity with respect to time during a two meter point-to-point movement using a crane control system in accordance with an exemplary embodiment of the present invention.

FIG. 12 provides a graphical illustration of the position of a crane, payload, and tag with respect to elapsed time during a two meter point-to-point movement using an exemplary crane control system of the present invention. FIG. 13 illustrates the reference velocity command signal and actual velocity with respect to time during the same two meter point-to-point movement with the exemplary crane control system of the present invention. The cut-off threshold 150 was set to 0.3 m. FIG. 12 illustrates that the crane moved two meters is only 7.5 seconds −2.5 seconds faster than with the PD feedback or P feedback crane control systems. Further, it is clear from FIG. 13 that noise is greatly reduced in the reference velocity command signal; thus, the crane is able to reach and sustain movements at its maximum velocity.

The present invention also improves over PD feedback and P feedback crane control systems by requiring less design components. PD feedback and P feedback systems require design of P gains, D gains, $e_{min}$, $e_{max}$, an input shaper, and/or filter components. On the other hand, some exemplary embodiments of the present invention do not require design of P gains, D gains, $e_{max}$, or the filter components; thus, crane control system design is greatly simplified.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the International Receiving Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. In a crane system comprising a crane trolley and a supporting device for carrying a payload, an improved crane control system useful for simplifying the crane system operation and in maintaining a safe distance between the payload and a desired location of safety, wherein a locator device is used for manipulating at least one of the position and speed of the supporting device, the crane control system also useful in dampening payload oscillations when the crane trolley is accelerated or decelerated, the improved crane control system comprising:

a real-time position-location module generating a position signal indicative of a vector between an element of the crane system and the desired location;

an on-off controller module mapping the position signal to a velocity command signal, wherein the velocity command signal comprises instructions for the crane trolley to move the supporting device in a vector relative to the desired location in at least a first velocity only if a magnitude of the vector between the element of the crane system and the desired location is greater than a cut-off threshold, wherein the at least a first velocity is substantially constant; and an input shaper module manipulating the velocity command signal mapped by the on-off controller module to dampen payload oscillations when the crane trolley is accelerated or decelerated.

2. The crane control system of claim 1, wherein the element of the crane system is the crane trolley and the position signal is indicative of a horizontal planar distance between the crane trolley and the desired location.

3. The crane control system of claim 1, wherein the locator device is portable.

4. The crane control system of claim 1, wherein the cut-off threshold is determined as a function of acceleration and/or deceleration properties of the crane trolley.

5. The crane control system of claim 1, wherein the cut-off threshold is determined as a function of one or more parameters of the payload.

6. The crane control system of claim 5, wherein the one or more parameters of the payload are chosen from the group consisting of weight of the payload, length of the payload, width of the payload, height of the payload, geometrical shape of the payload, and material of the payload.

7. The crane control system of claim 1, wherein the cut-off threshold is determined in conjunction with one or more properties of the input shaper module.

8. The crane control system of claim 1, wherein the cut-off threshold is determined as a function of a vector position of the desired location with respect to the crane trolley.

9. The crane control system of claim 1, wherein the at least a first velocity is equal to the first velocity if a magnitude of the vector between the element of the crane system and the desired location is greater than the cut-off threshold and less than or equal to an intermediate threshold, and the at least a first velocity is equal to a second velocity greater than the first velocity if the magnitude of the vector between the element of the crane system and the desired location is greater than the intermediate threshold.

10. The crane control system of claim 1, wherein the real-time position-location module uses characteristics of ultra-wide-band radio-frequency signals that are emitted by the locator device and received by a plurality of sensors.

11. The crane control system of claim 1, wherein the desired location is the location of the locator device.

12. In a crane system comprising a crane trolley and a supporting device for carrying a payload, a radio-frequency-based crane control system, comprising a real-time position-location subsystem, comprising:

a portable locator device emitting ultra-wide-band radio-frequency signals in response to an input;

a plurality of sensors positioned at known locations and receiving the ultra-wide-band radio-frequency signals; and a real-time position-location module using the received ultra-wide-band radio-frequency signals to generate a position signal indicative of a horizontal planar distance between the crane trolley and the portable locator device;

an on-off controller module mapping the position signal to a velocity command signal, wherein the velocity command signal comprises instructions for the crane trolley to move in a vector relative to the locator device in at least a first velocity only if the horizontal planar distance between the crane trolley and the locator device is greater than a cut-off threshold, wherein the at least a first velocity is substantially constant; and an input shaper module manipulating the velocity command signal mapped by the on-off controller module to dampen payload oscillations when the crane trolley is accelerated or decelerated.

13. The radio-frequency-based crane control system of claim 12, wherein the cut-off threshold is determined as a function of acceleration and/or deceleration properties of the crane trolley.

14. The radio-frequency-based crane control system of claim 12, wherein the cut-off threshold is determined as a function of a vector position of the locator device with respect to the crane trolley.

15. The radio-frequency-based crane control system of claim 12, wherein the cut-off threshold is determined as a function of one or more parameters of the payload.

16. The radio-frequency-based crane control system of claim 15, wherein the one or more parameters of the payload are chosen from the group consisting of weight of the payload, length of the payload, width of the payload, height of the payload, geometrical shape of the payload, and material of the payload.

17. The radio-frequency-based crane control system of claim 12, wherein the cut-off threshold is determined in conjunction with one or more properties of the input shaper module.

18. The radio-frequency-based crane control system of claim 12, wherein the at least a first velocity is equal to the first velocity if the horizontal planar distance between the crane trolley and the locator device is greater than the cut-off threshold and less than or equal to an intermediate threshold, and the at least a first velocity is equal to a second velocity greater than the first velocity if the horizontal planar distance between the crane trolley and the locator device is greater than the intermediate threshold.

19. A method of controlling a crane system, comprising:

generating a position signal indicative of a vector between a desired location and an element of the crane system;

mapping the position signal to a velocity command signal, wherein the velocity command signal comprises instructions for the crane trolley to move in a vector relative to the desired location in at least a first velocity only if the magnitude of the vector between the element of the crane system and the desired location is greater than a cut-off threshold, wherein the at least a first velocity is substantially constant;

manipulating the velocity command signal to dampen payload oscillations when the crane trolley is accelerated or decelerated.

20. The method of controlling a crane of claim 19, wherein the cut-off threshold is determined as a function of acceleration and/or deceleration properties of the crane trolley.

21. The method of controlling a crane of claim 19, wherein the cut-off threshold is determined as a function of a vector position of the locator device with respect to the crane trolley.

22. The method of controlling a crane of claim 19, wherein the cut-off threshold is determined as a function of one or more parameters of a payload.

23. The method of controlling a crane of claim 22, wherein the one or more parameters of the payload are chosen from the group consisting of weight of the payload, length of the payload, width of the payload, height of the payload, geometrical shape of the payload, and material of the payload.

24. The method of controlling a crane of claim 19, wherein the cut-off threshold is determined in conjunction with manipulating the velocity command signal.

25. The method of controlling a crane of claim 19, wherein the at least a first velocity is equal to the first velocity if the magnitude of the vector between the element of the crane system and the desired location is greater than the cut-off threshold and less than or equal to an intermediate threshold, and the at least a first velocity is equal to a second velocity greater than the first velocity if the magnitude of the vector between the element of the crane system and the desired location is greater than the intermediate threshold.

26. The method of controlling a crane of claim 19, wherein the desired location is the location of a locator device.

27. The method of controlling a crane of claim 26, wherein the step of generating a position signal uses characteristics of ultra-wide-band radio-frequency signals that are emitted by the locator device and received by a plurality of sensors.

28. The method of controlling a crane of claim 19, wherein the element of the crane system is the crane trolley and the position signal is indicative of a horizontal planar distance between the crane trolley and the desired location.

* * * * *